US005476831A

United States Patent [19]

Beck et al.

[11] Patent Number: 5,476,831

[45] Date of Patent: Dec. 19, 1995

[54] THERMAL TRANSFER PRINTING RECEIVER

[75] Inventors: Nicholas C. Beck, Manningtree; Richard A. Hann, Ipswich; Gary W. Morrison, London, all of England

[73] Assignee: Imperial Chemical Industries PLC, London, England

[21] Appl. No.: 244,024

[22] Filed: Aug. 29, 1994

[30] Foreign Application Priority Data

Nov. 15, 1991 [GB] United Kingdom ..... 9124302

[51] Int. Cl.[6] ..... B41M 5/035; B41M 5/38

[52] U.S. Cl. ..... 503/227; 428/195; 428/323; 428/336; 428/480; 428/913; 428/914

[58] Field of Search ..... 428/195, 323, 428/336, 480, 913, 914; 503/227

[56] References Cited

U.S. PATENT DOCUMENTS 5,252,535 10/1993 Martin et al. ..... 503/227

*Primary Examiner*—B. Hamilton Hess

*Attorney, Agent, or Firm*—Cushman Darby & Cushman

[57] ABSTRACT

A thermal transfer printing receiver sheet for use in security laminates, comprises a substrate supporting a receiver coat of a dye-receptive composition on one side and a backcoat on the other, wherein the backcoat comprises a thermoplastic polymer having a Tg less than 130° C., and dispersed therein a particulate solid material in amount 1–24% by weight of the thermoplastic polymer and an average particle size of 0.3–10 μm. The security laminates are prpared after printing the receiver with an image, by bonding a first cover sheet of plastics material to the printed receiver coat so as to overlie the image, and a second cover sheet of plastics material can be bonded to the present backcoat more readily than to a highly crosslinked backcoat, using common adhesives. For greater security, thicker than normal backcoats are used.

10 Claims, No Drawings

THERMAL TRANSFER PRINTING RECEIVER

The invention relates to receiver sheets for dye-diffusion thermal transfer printing, and in particular to receiver sheets for use in security laminates in which the receiver sheet after printing is laminated to protective cover sheets on both its printed side and its reverse side. The invention also relates to security laminates comprising such printed receiver sheets.

Security laminates are presently based on various types of information-carrying sheets laminated to cover sheets. These typically have at least one side carrying pictorial information in the form of a normal optical photograph, including typed script and/or signatures as appropriate. This is bonded to a cover sheet on each side. These cover sheets normally overlap to bond to each other and form a pouch, at least during manufacture, but in the final product the information carrying sheet may have raw unprotected edges, eg when cards or tags are stamped or cut out of a larger area.

An alternative to optical photography as a means of producing pictorial representations of persons, signatures, graphics and other such form of information, is thermal transfer printing. However, while this technology can provide some advantages, particularly in its versatility, it can also produce difficulties in lamination.

Thermal transfer printing is a generic term for processes in which one or more thermally transferable dyes are caused to transfer from a dyesheet to a receiver in response to thermal stimuli. Using a dyesheet comprising a thin substrate supporting a dyecoat containing one or more such dyes uniformly spread over an entire printing area of the dyesheet, printing can be effected by heating selected discrete areas of the dyesheet while the dyecoat is pressed against a receiver sheet, thereby causing dye to transfer to corresponding areas of that receiver. The shape of the pattern transferred is determined by the number and location of the discrete areas which are subjected to heating. Full colour prints can be produced by printing with different coloured dyecoats sequentially in like manner, and the different coloured dyecoats are usually provided as discrete uniform print-size areas in a repeated sequence along the same dyesheet.

High resolution photograph-like prints can be produced by these techniques using appropriate printing equipment, such as a programmable thermal print head or laser transfer printer, controlled by electronic image signals derived from a video, computer, electronic still camera, or similar signal generating apparatus. A typical high speed thermal print head has a row of individually operable tiny heaters spaced to print six or more pixels per millimeter, using very short hot pulses.

Receiver sheets comprise a substrate supporting a receiver coat of a dye-receptive composition containing a material having an affinity for the dye molecules, and into which they can readily diffuse when an area of dyesheet pressed against it is heated during printing. Such receives coats are typically around 2–6 μm thick, and materials with good dye-affinity are generally thermoplastic polymers of low softening point, such as saturated polyesters. They also normally contain a release system, to prevent it sticking to the dyesheet when printing with pulses at temperatures sufficiently high otherwise to fuse the receiver coat and dye-binder together.

Most receiver sheets also have one or more backcoats on the side of the substrate remote from the receiver coat. These are generally based on a cross-linked polymer binder, and are provided to fulfil a number of different roles, including improvement of handling properties to enable sheets to be fed individually to the printer, as required, from a stack or cassette of such sheets. For example antistatic backcoats may have the cross-linked polymer binder doped with an antistatic agent or particulate slipping agent to improve handling of the sheets.

In practice, it is normally important for polymer binder of the backcoat to be cross-linked, so as to avoid low temperature retransfer of dyes from a printed receiver coat into the backcoat of an overlying print, eg when several prints are stored together in a stack. The source of this problem arises from the nature of the dyes used, these having to be sufficiently mobile to diffuse from one polymer environment into another when heat is applied by the printer. However, the dyes are not normally fixed in the printed receiver coat, and retain their mobility, so that when a print is held against another polymer surface of high dye-affinity composition, there is a danger of some of the dye diffusing into that surface composition even at ambient temperatures if left long enough, eg during prolonged storage in contact with each other. Strong cross-linking of the backcoat binder produces a polymer matrix which is far more resistant to diffusion of the dyes, and hence minimises their retransfer.

The lamination difficulties referred to at the outset herein, can occur on both sides of a thermal transfer print, both the dye-receiving layer and the backcoat being loath to adhere to otherwise suitable heat activated adhesives. With the receiver coat, it is the presence of a silicone release system that usually causes the problem, but this we have found can be overcome by adjusting the proportion of the release system in the receiver coat composition. We have also now found that the difficulties associated with lamination of the backcoat can be overcome by using a different backcoat composition.

According to the present invention, a thermal transfer printing receiver sheet for use in security laminates, comprises a substrate supporting a receiver coat of a dye-receptive composition on one side and a backcoat on the other, characterised in that the backcoat comprises a thermoplastic polymer having a Tg less than 130° C., and dispersed therein a particulate solid material in amount 1–24% by weight of the thermoplastic polymer and an average particle size of 0.3–10 μm.

The backcoats of the invention have been found generally to give good adhesion to laminating materials using regular known adhesives, and to have good handling properties. This latter feature is of particular importance, because we had found that receivers having backcoats of the thermoplastic polymers on their own, especially those wherein the polymer was essentially the same as that used for the receiver coat, suffered badly from poor handling properties. This was especially noticeable when being fed to the printer or laminater using automatic feed. However, the particulate solids described herein enabled similar (and even the same) thermoplastic polymers to be used on both sides of the substrate, while not detracting significantly from the adhesion attainable using a backcoat of the present thermoplastic polymer. Thus one is enabled to select a backcoat polymer that is most suitable for the laminating adhesive to be used, and while retransfer could still be a problem were the unlaminated prints left stored in a stack for long periods, once laminated, the backcoat is protected from such problems by the adhered overlying sheet.

Preferred receiver sheets are those in which at least a major proportion of the thermoplastic polymer of the backcoat is an amorphous polyester. Examples of these which are commercially available include Vitel PE 200 (Goodyear), and Vylon polyesters (Toyobo), especially grades 103 and 200. Of these the different grades of amorphous polyesters, from the same manufacturer at least, are generally compatible, and can be mixed to provide a composition of the desired Tg (the manufacturers quoting the Tg values of Vylon 103 and 200 as 47° C. and 67° C. respectively, ±4° C.). For higher overall Tgs, Vylon 290 (Tg 77° C. ±4° C.) may be used alone or in combination with the others. For all solvent-soluble thermoplastic polymers, and blends thereof with other thermoplastic polymers, that we have tested, we have found that changes in the Tg of the polymer made little if any difference to the adhesion achieved on lamination. However the higher the Tg, the lower the solubility of the polymer, and for this reason we prefer to use polyesters having a Tg of between 20° C. and 85° C.

The particulate material may be a single species, especially in the smaller sizes, but a mixture of smaller and larger particles within the specified range, is preferred. At the lower end, various micronised solids of both organic and inorganic origins, are suitable. These generally have a size of about 0.3–2 μm, and can be used in a variety of concentrations irrespective of the coating thickness. However, we generally prefer to use low concentrations, and amounts in the range 1–15% by weight of the thermoplastic polymer are particularly suitable, particularly preferred is a backcoat in which the particulate material consists essentially of a micronised solid in amount of about 1.5% by weight of the thermoplastic polymer.

The backcoats may also be made more deeply textured, by using larger particles, ie 2–10 μm in diameter. These are preferably used in smaller quantities than the smaller particles, suitably 1–5% by weight of the polymer.

An example of the smaller particulate material for the backcoat is a micronised urea formaldehyde polymer, such as that sold under the name Pergopak M3 by Martinswerk, which we find gives good handling properties over a wide range of concentrations. Even with the higher amounts of such solids, good adhesion can be obtained without undue friction.

Larger particles include silica particles 2–10 μm in diameter, embedded in the backcoat polymers. Examples include Syloid 244, sold by Grace, with particles typically 2 μm in diameter. These larger particles may provide some antiblocking actions, but even without such larger particles, we have experienced surprisingly little blocking problems when using the present backcoats containing only the micronised materials described above.

When using a mixture of smaller and larger particles, a preferred ratio of larger (2–10 μm) to smaller (0.3–2 μm) particles is in the range 1::5–1:7 for most applications, but ratios outside that range may be used to obtain special effects.

The above receiver sheets are particularly adapted for use in a security laminate and analogous purposes, wherein the receiver coat contains at least one thermal transfer dye located in selected positions to form an image, a first cover sheet of plastics material is bonded to the printed receiver coat to overlie the image, and a second cover sheet of plastics material is bonded to the backcoat.

According to a second aspect of the present invention, a security laminate comprises an information sheet printed with an information-containing image and having a protective cover sheet bonded to each side, characterised in that the information sheet is a thermal transfer printing receiver sheet comprising a substrate supporting on one side a receiver coat of a dye-receptive composition containing at least one thermal transfer dye located in selected positions to form the image, and on the other side a backcoat comprising a thermoplastic polymer having a Tg less than 130° C., and dispersed therein a particulate solid material in amount 1–24% by weight of the thermoplastic polymer and an average particle size of 0.3–10 μm; a first of the cover sheets being formed of a plastics material which is bonded to the printed receiver coat to overlie the image, and a second of the cover sheets being formed of a plastics material which is bonded to the backcoat.

The cover sheets may be the same or different, transparent or filled, although at least one of them must be transparent if the print is to be visible from outside the laminate. Examples of cover sheets include thermoplastic films, such as polyvinylchloride, orientated polyethyleneterephthalate, or polycarbonate compositions.

The cover sheet can be a supportive card-like sheet, even to the extent of being the major contributor to the total thickness of the final laminate. Such cover sheets are particularly suitable for stand-alone uses; credit cards, security cards and card-keys being examples, where a suitable thickness may typically be about 200 μm for the two cover sheets, and about 50 μm for the receiver sheet.

The supportive cover sheet may itself be a laminate, this being useful where a particular surface texture or design is required on the back of the laminate, for example, or some functional feature (eg a card-key key function) is to be concealed between the layers of the laminated cover sheet.

For other applications, much thinner cover sheets, such as transparent thermoplastic films, may generally be preferred. These laminates include pouch laminates in which both cover sheets have peripheral portions extending beyond the edges of the receiver sheet, these extended peripheral portions being bonded to each other. Within this pouch is secured the printed receiver sheet with both its receiver coat and its backcoat bonded to the overlying cover sheets.

The dye-receptive organic polymer forms the bulk of the receiver coat composition. This may comprise a single species of polymer, or may be a mixture. Particularly suitable dye-receptive organic polymers are the amorphous polyesters described hereinabove for use in the backcoat. The organic polymer composition may also contain additional polymers, such as polyvinyl chloride/polyvinyl alcohol copolymer, for example.

Preferred release systems comprise a thermoset reaction product of at least one silicone having a plurality of hydroxyl groups per molecule and at least one organic polyfunctional N-(alkoxymethyl) amine resin reactive with such hydroxyl groups under acid catalysed conditions.

EXAMPLES

To illustrate further the present invention, five security pouch laminates were prepared.

EXAMPLE 1

Receiver Sheet

A web of white biaxially orientated polyester film (Melinex 990 from ICI) was provided with a receiver coat, followed by a backcoat. The receiver coat coating composition was:

| | | |
|---|---|---|
| Vylon 200 | 500 | parts by weight |
| Tegomer HSi 2210 | 0.65 | " |
| Cymel 303 | 4 | " |
| Nacure 2530 | 1.0 | " |
| Tinuvin 234 | 5 | " |

-continued

| | |
|---|---|
| toluene/MEK | 60/40 solvent mixture |

Tegomer HSi 2210 is a bis-hydroxyalkyl polydimethylsiloxane sold by Goldshmidt, cross-linkable by the Cymel 303 under acid conditions to provide a release system effective during printing. Cymel 303 is a hexamethoxymethylmelamine from American Cyanamid. Nacure 2538 is an amine-blocked p-toluene sulphonic acid catalyst, and Tinuvin 900 is a UV stabiliser.

This coating composition was made by mixing three functional solutions, one containing the dye-receptive Vylon and the Tinuvin UV absorber, a second containing the Cymel cross linking agent, and the third containing both the Tegomer silicone release agent and the Nacure solution to catalyse the crosslinking polymerisation between the Tegomer and Cymel materials. These were then mixed immediately prior to coating, and the quantity of solvent adjusted to give a final solution with an approximately 12% total solids content. The composition was laid down by bead coating method, dried, and cured by heating at 140° C. for 30 s.

A backcoat was then added, the coating composition being:

| | |
|---|---|
| Pergopak M3 | 4.5 g |
| Vylon 200 | 150 g |
| Vylon 103 | 150 g |
| Atmer 190 | 0.75 g |
| toluene/MEK | 40/60 solvent mixture |

where Atmer 190 is a surfactant.

This was applied to the reverse side of the substrate as for the receiver coat, and dried at 110° C. for 30 s.

The receiver was printed using a Hitachi VY200 printer. and part of the print was cut out using a punch. This portion was then tested for lamination capabilities.

Lamination

An asymmetric Transilwrap pouch from Morane was used. This had polyethyleneterephthalate film cover sheets, one coated with a polyester adhesive (DDOT), and the other a ethylene/vinylacetate copolymer adhesive (Morane type 7/3). The punched portion of the print was placed in the pouch with the polyesther adhesive against the receiver coat and the type 7/3 adhesive against the backcoat. There was overlap all round the periphery of the print. Lamination was effected in a laminator at a temperature of 175 ° C.

EXAMPLE 2

Example 1 was repeated except that in the backcoat composition the polyester was 300 g Vylon 103 (ie no Vylon 200).

EXAMPLE 3

Example 1 was repeated except that in the backcoat composition the polyester was 300 g Vylon 200 (ie no Vylon 103).

EXAMPLE 4

Example 1 was repeated except that in the backcoat composition the polyester was a mixture of 300 g Vylon 103 and 16 g styrene-maleic anhydride copolymer.

EXAMPLE 5

Example 4 was repeated except that in the backcoat composition the styrene-maleic anhydride copolymer was replaced by a butylated melamine formaldehyde resin (Beetle B681).

Results for Examples 1–5

All the backcoats gave satisfactory lamination, all requiring some force to be applied to separate the print from the laminated cover sheet, even when an edge was exposed by cutting the card. On more rigorous testing the composition of Example 1 appeared to provide the strongest bond.

EXAMPLE 6

In this Example, three commercial polyesters having Tg's of 23, 47 and 67 respectively, were compared as regards their suitability for use in laminatable backcoats. Solutions of each of the polyesters were prepared as before (but omitting the particles which were not essential for this test) and coated onto a substrate of Melinex 990 polyester film, each in six different thickness whose dry values in μm are shown in the tables below. These polyesters were GK130, Vylon 103 (V103) and Vylon 200 (V200) from Toyobo. A sample of each was laminated to Morane DDOT, this being a polyester base melt coated with an amorphous polyester, at a lamination temperature of 150° C. A further laminate was also prepared, but at the thickest coating level only, using as backcoat polymer a 50/50 mixture of GK130 and V103.

Each of these laminates was subjected to a peel strength test. This was carried out on an Instron tensile tester by sticking a 2 cm wide portion, using double sided tape, onto an aluminium plate, one end of which was clamped in the lower jaws of the tester. A delaminated tail was folded back on itself, and clamped in the upper jaw. The jaws were then drawn apart at 23 mm/sec through 100 mm, and the measured load plotted every 2 s. The graphs passed through an initial peak, which is given in Table 1 below. The average peel force is also given below, in Table 2.

TABLE I

| | Crack Initiation Force (180° C.)(N/cm) | | | | | |
|---|---|---|---|---|---|---|
| Thickness | 1.6 | 4.96 | 8.7 | 13.8 | 24.2 | 30.3 |
| GK130 Tg = 23 | 6.07 | 13.69 | 14.79 | 18.72 | 19.99 | 21.79 |
| V103 Tg = 47 | 12.89 | 15.97 | 19.62 | 22.75 | 30.24 | 30.93 |
| V200 Tg = 67 | 14.32 | 16.94 | 20.25 | 21.12 | 21.22 | 23.7 |
| GK130/V1O3 (50/50) | — | — | — | — | — | 24 |

TABLE 2

| | Average Peel Force (180° C.)(N/cm) | | | | | |
|---|---|---|---|---|---|---|
| Thickness | 1.6 | 4.96 | 8.7 | 13.8 | 24.2 | 30.3 |
| GK130 Tg = 23 | 0.75 | 12.6 | 13.59 | 14.04 | 17.07 | 18.5 |
| V103 Tg = 47 | 9.33 | 9.87 | 12.03 | 12.05 | 13.44 | 14.03 |
| V200 Tg = 67 | 9.64 | 9.11 | 11.05 | 11.53 | 11.00 | 13.26 |
| GK130/V1O3 (50/50) | — | — | — | — | — | 19.2 |

The results show how changes in the thickness of the backcoat can have a more pronounced effect than changes in Tg, the thicker backcoats giving the greater security on lamination. Thus whereas in the past backcoat thicknesses have typically been of the order of 1–3 μm, ie just sufficient to provide a crosslinked dye barrier or hold antistatic agents or hard particles to give writability, for the present purpose of providing laminatibility, we prefer the backcoat to be at least 4 μm thick, especially when greater than about 10 μm. We particularly prefer to use the backcoats in thicknesses greater than 20 μm where possible, but as the coatings become thicker they also become more difficult to produce with consistency, eg particularly much above about 33 μm.

EXAMPLES 7–9

Further backcoat formulations as set out in Table 3 below, have been coated onto Melinex 990 film, and subsequently laminated to Morane DDOT at 150° C., essentially as described above. All gave good adhesion to the cover.

TABLE 3

| Example | 7 | 8 | 9 |
|---|---|---|---|
| E1055 | 59.21 | — | — |
| Ketjenflex | — | — | 49.1 |
| V300 | — | — | 49.1 |
| V6OO | 39.1 | — | — |
| G49000 | — | 98.25 | — |
| Pergopak M3 | 1.5 | 1.5 | 1.5 |
| Atmer 190 | 0.25 | 0.25 | 0.25 |

where:

E1055 is an epoxy resin from Shell

Ketjenflex is a low Tg, low molecular weight toluene sulphonamide formaldehyde.

G49000 is an amorphous polyester from Goodyear, and

Atmer 190 is a surfactant.

EXAMPLE 10

In this Example, a sample of receiver sheet essentially as described in Example 1, was placed in a first pouch from Morane, being a symmetric pouch having both cover sheets coated with DDOT polyester (unlike the asymmetric pouch from Morane in Example 1), and a second sample was placed in a pouch from Kodak, also symmetric. Lamination was carried out at temperatures as indicated in Table 4 below. The bond strengths were measured on an Instron tensile tester, as described above, and the results are recorded in Table 4.

In Comparative Examples C1 and C2, similar tests were also carried out on two commercially available receivers, both believed to have a backcoat crosslinked in the normal manner.

TABLE 4

| | | Bond strengths (N/cm) | | | |
|---|---|---|---|---|---|
| | | Lamination Temperature °C. | | | |
| Example | | 100 | 125 | 150 | 180 |
| 10/DDOT | r/c | 12.49 | 15.42 | 14.15 | 12.67 |
| " | b/c | 12.14 | 12.07 | 14.93 | 14.45 |
| 10/Kodak | r/c | 9.90 | 7.07 | 10.66 | — |
| " | b/c | 11.58 | 13 75 | 16.15 | — |
| C1/DDOT | r/c | — | — | — | 2.13 |
| " | b/c | 5.15 | 7.90 | 8.66 | 6.75 |
| C1/Kodak | r/c | 4.95 | 5.73 | 5.57 | — |

TABLE 4-continued

| | | Bond strengths (N/cm) | | | |
|---|---|---|---|---|---|
| | | Lamination Temperature °C. | | | |
| Example | | 100 | 125 | 150 | 180 |
| " | b/c | 3.16 | 3.60 | 4.24 | — |
| C2/DDOT | r/c | — | — | 1.39 | — |
| " | b/c | — | — | 3.13 | — |
| C2/Kodak | r/c | 1.30 | 1.36 | 0.83 | — |
| " | b/c | 2.05 | 1.96 | 3.19 | — |

wherein r/c is the receiver coat, and b/c is the backcoat

As can be seen from these results, receiver sheets that are specifically adapted for lamination by use of a backcoat of the present invention, are capable of providing a more secure laminate than known receivers produced for general purposes rather than for particular use in security laminates.

We claim:

1. A thermal transfer printing receiver sheet comprising a substrate supporting a receiver coat of a dye-receptive composition on one side and a backcoat on the other, characterised in that the backcoat comprises a thermoplastic polymer having a Tg less than 130° C., and dispersed therein a particulate solid material in amount 1–24% by weight of the thermoplastic polymer and an average particle size of 0.3–10 μm.

2. A thermal transfer printing receiver sheet as claimed in claim 1, characterised in that at least a major proportion of the thermoplastic polymer of the backcoat is an amorphous polyester.

3. A thermal transfer printing receiver sheet as claimed in claim 2, characterised in that the polyester has a Tg of between 20° C. and 85° C.

4. A thermal transfer printing receiver sheet as claimed in claim 2, characterised in that the thermoplastic polymer comprises a mixture of a polyester and a styrene-maleic anhydride copolymer.

5. A thermal transfer printing receiver sheet as claimed in claim 2, characterised in that the polymer comprises a mixture of a polyester and a butylated melamine formaldehyde resin.

6. A thermal transfer printing receiver sheet as claimed in claim I, characterised in that the particulate material comprises particles having an average size of 0.3–2 μm in an amount of 1–15% by weight of the thermoplastic polymer.

7. A thermal transfer printing receiver sheet as claimed in claim 6, characterised in that the particulate material consists essentially of a micronised solid in amount of about 1.5% by weight of the thermoplastic polymer.

8. A thermal transfer printing receiver sheet as claimed in claim 1, characterised in that the backcoat has a thickness of at least 4 μm.

9. A thermal transfer printing receiver sheet as claimed in any one of claims 1 to 8, characterised in that a) the receiver coat contains at least one thermal transfer dye located in selected positions to form an image, b) a first cover sheet of plastics material is bonded to the printed receiver coat to overlie the image, and c) a second cover sheet of plastics material is bonded to the backcoat.

10. A security laminate comprising an information sheet printed with an information-containing image and having a protective cover sheet bonded to each side, characterised in that the information sheet is a thermal transfer printing receiver sheet comprising a substrate supporting on one side a receiver coat of a dye-receptive composition containing at least one thermal transfer dye located in selected positions to form the image, and on the other side a backcoat comprising a thermoplastic organic polymer having a Tg less than 130° C., and dispersed therein a particulate solid material in amount 1–24% by weight of the thermoplastic polymer and an average particle size of 0.3–10 μm; a first of the cover sheets being formed of a plastics material which is bonded to the printed receiver coat to overlie the image, and a second of the cover sheets being formed of a plastics material which is bonded to the backcoat.

* * * * *